US009957089B2

(12) United States Patent
Rogers

(10) Patent No.: US 9,957,089 B2
(45) Date of Patent: May 1, 2018

(54) FLEXIBLE CONTAINER LID

(71) Applicant: Michael Wayne Rogers, Vero Beach, FL (US)

(72) Inventor: Michael Wayne Rogers, Vero Beach, FL (US)

(73) Assignee: LitterBin, LLC, Vero Beach, FL (US)

( * ) Notice: Subject to any disclaimer, the term of this patent is extended or adjusted under 35 U.S.C. 154(b) by 0 days. days.

(21) Appl. No.: 15/341,073

(22) Filed: Nov. 2, 2016

(65) Prior Publication Data

US 2017/0121066 A1 May 4, 2017

Related U.S. Application Data

(60) Provisional application No. 62/249,709, filed on Nov. 2, 2015.

(51) Int. Cl.
*B65D 43/06* (2006.01)
*B65F 1/16* (2006.01)

(52) U.S. Cl.
CPC ..... *B65D 43/06* (2013.01); *B65F 1/1607* (2013.01)

(58) Field of Classification Search
CPC ..... B65D 43/06; B65F 1/16
USPC ..... 220/229, 377, 212
See application file for complete search history.

(56) References Cited

U.S. PATENT DOCUMENTS

| | | | | |
|---|---|---|---|---|
| 1,983,139 | A | 12/1934 | Lovell | |
| 4,138,055 | A * | 2/1979 | Harrison | B42D 17/00 232/1 C |
| 5,165,564 | A | 11/1992 | Prout et al. | |
| 6,843,387 | B2 | 1/2005 | Karaki et al. | |
| 7,396,176 | B2 * | 7/2008 | Schoemer | A47G 19/303 118/26 |
| 7,766,168 | B2 | 8/2010 | Thrapp et al. | |
| 2005/0252923 | A1 * | 11/2005 | Woolf | A47G 19/30 220/731 |
| 2005/0263523 | A1 * | 12/2005 | Moss | B65D 43/0212 220/229 |
| 2012/0234849 | A1 | 9/2012 | Hughes et al. | |
| 2014/0238892 | A1 | 8/2014 | Wallwork | |

* cited by examiner

*Primary Examiner* — King M Chu
(74) *Attorney, Agent, or Firm* — Dunlap Bennett & Ludwig PLLC

(57) ABSTRACT

A flexible container lid requiring only one hand to secure objects in an associated container is provided. The lid has a lid aperture providing a medial passageway from which a plurality of narrow openings radially extends so that the lid aperture expands as objects are urged onto it and the flexible lid moves from a flat condition to a bowed condition. Thereby accommodating items that are larger than the centrally located medial passageway by using the narrow openings in conjunction with the medial passageway to expand the size of the entire lid aperture in the bowed condition as the portions of the lid that define each narrow opening simultaneously move way from each other, respectively. Furthermore, the lid returns to its starting flat condition covering the associated container once an item has been placed therein, obviating the need for a user to initially remove the lid from the container.

4 Claims, 4 Drawing Sheets

FLEXIBLE CONTAINER LID

CROSS-REFERENCE TO RELATED APPLICATION

This application claims the benefit of priority of U.S. provisional application No. 62/249,709, filed 2 Nov. 2015, the contents of which are herein incorporated by reference.

BACKGROUND OF THE INVENTION

The present invention relates to container lids and, more particularly, to a flexible container lid providing a lid aperture having a medial passageway from which a plurality of narrow openings radially extends so that the lid aperture expands as objects are urged onto it and the flexible lid moves from a flat condition to a bowed condition, thereby requiring only one hand to secure objects within an associated container.

Traditional storage containers/trashcans, such as Tupperware®, require two hands to open its lid: one hand may be used to secure a base of the storage container while the other hand must be used to remove the lid from perimeter of the storage container. Additionally, traditional lids may be difficult to secure back onto the container without using the same process in reverse. This makes it difficult to store trash or small items while conducting other activities, such as driving. Which tempts people to forgo using a secure lid, which in turn leads to the loss or spillage of the items retained within the container.

As can be seen, there is a need for a flexible container lid that requires only one hand to secure objects in an associated container by providing a lid aperture having a medial passageway from which a plurality of narrow openings radially extend so that the lid aperture expands as objects are urged onto it and through it, as the flexible lid moves from a flat condition to a bowed condition.

SUMMARY OF THE INVENTION

In one aspect of the present invention, a flexible container lid includes a sheet of material circumscribed by a rim; a passageway centrally disposed in the sheet; a plurality of elongated openings formed in the sheet, each elongated opening radially extending from the passageway toward the rim, the plurality of elongated openings movable between a flat condition and a bowed condition; and the material biasing the plurality of elongated openings in the flat condition.

In another aspect of the present invention, the flexible container lid includes a sheet of material circumscribed by a rim; a void centrally disposed in the sheet; a plurality of elongated openings formed in the sheet, each elongated opening radially extending from the passageway toward the rim, the plurality of elongated openings movable between a flat condition and a bowed condition, and wherein each elongated opening is defined by two adjacent lid segments, and wherein moving to the bowed condition separates the respective two adjacent lid segments and expands the void; the material biasing the plurality of elongated openings in the flat condition; the rim providing a retaining space; a plurality of spaced apart handle flanges extending outwardly from the rim; and a plurality of retaining teeth disposed along each handle flange so that the plurality of retaining teeth extends inward further defining the retaining space.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a flexible container lid providing a lid aperture communicating to an associated container, whereby only one hand is required to secure objects therein. The lid aperture provides a medial passageway from which a plurality of narrow openings radially extends so that the lid aperture expands as objects are urged onto and through it as the flexible lid moves from a flat condition to a bowed condition. The flexible lid thereby accommodates items that are larger than the centrally located medial passageway by using the narrow openings in conjunction with the medial passageway to expand the size of the entire lid aperture in the bowed condition as the portions of the lid that define each narrow opening simultaneously move way from each other, respectively. Furthermore, the lid of the present invention is able to return to its starting flat condition covering the associated container once an item has been placed therein, obviating the need for a user to place the lid back onto the container, since the lid was never removed initially.

In this detailed description of the present invention, a person skilled in the art should note that directional terms, such as "outward", "inward", "downward", "upward" and other like terms are used for the convenience of the reader in reference to the drawings. Also, a person skilled in the art should notice this description may contain other terminology to convey position, orientation, and direction without departing from the principles of the present invention.

Referring to FIGS. 1 through 6, the present invention may include a flexible container lid 10. According to an embodiment of the present invention, the flexible container lid 10 may be a circular plastic extrusion adapted to be placed on top of a container 20. Those skilled in the art will appreciate that although the flexible lid 10 is illustrated as being circular, the flexible lid 10 may have any shape to accommodate any type of container 20. For example, the flexible lid 10 may have a square shape or another polygonal shape to accommodate a similarly shaped container 20.

Figure 1:
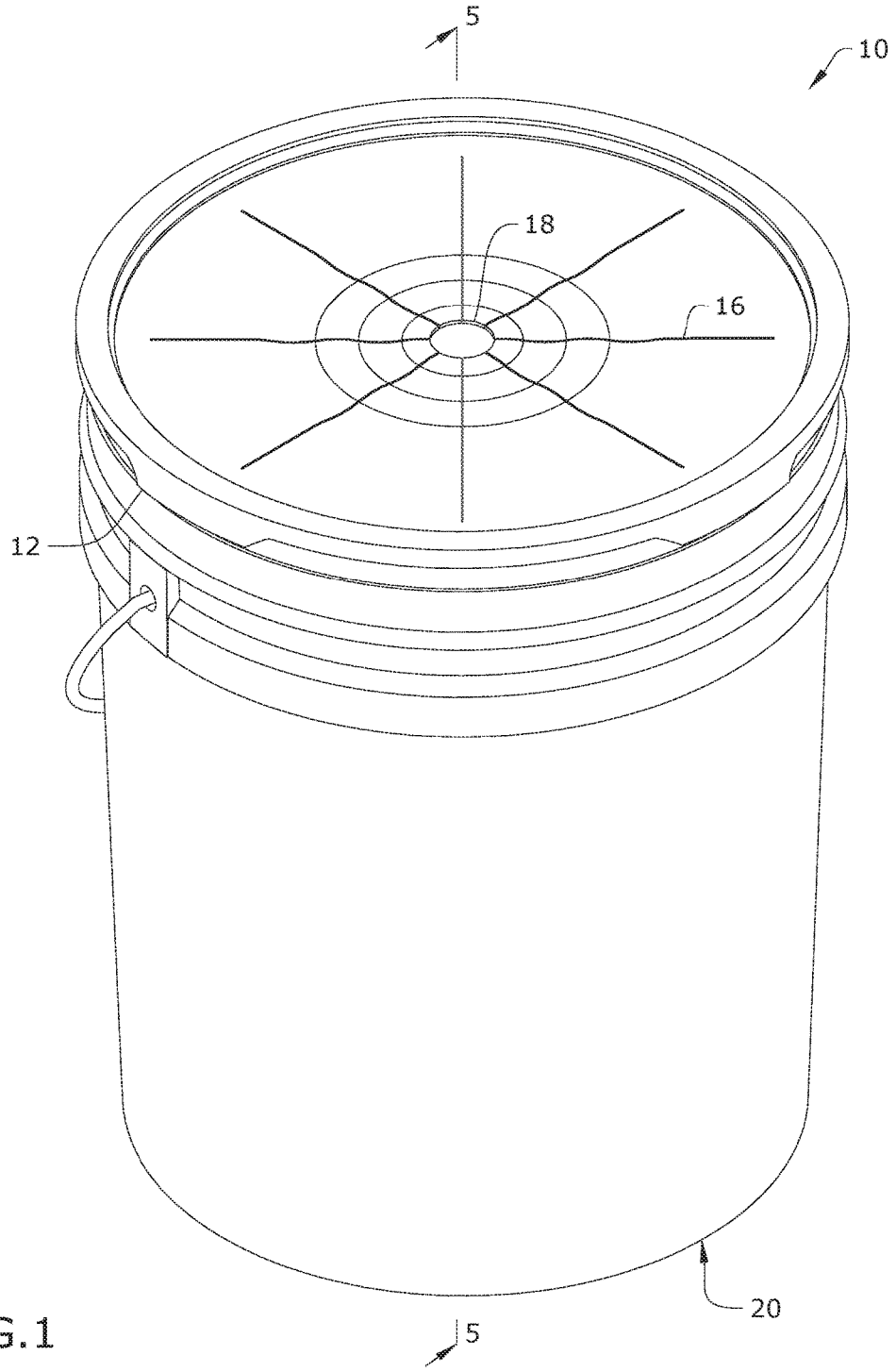
FIG. 1 is a perspective view of an exemplary embodiment of the present invention, shown in use on a container.
Figure 2:
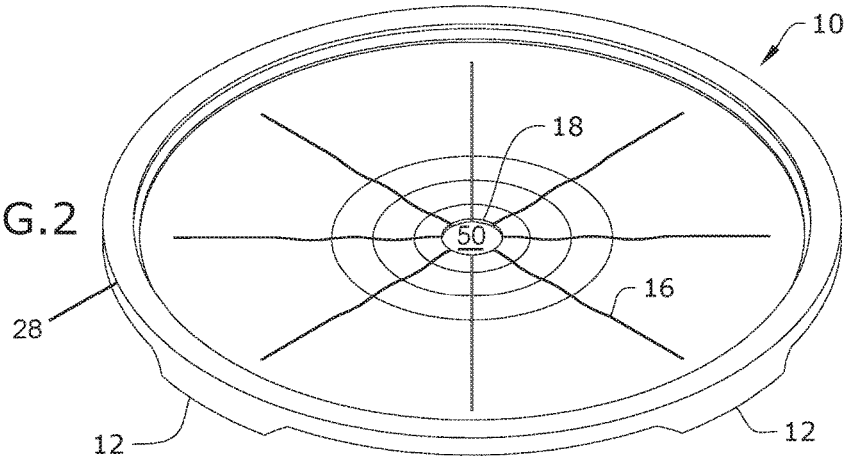
FIG. 2 is a top perspective view of an exemplary embodiment of the present invention.
Figure 3:
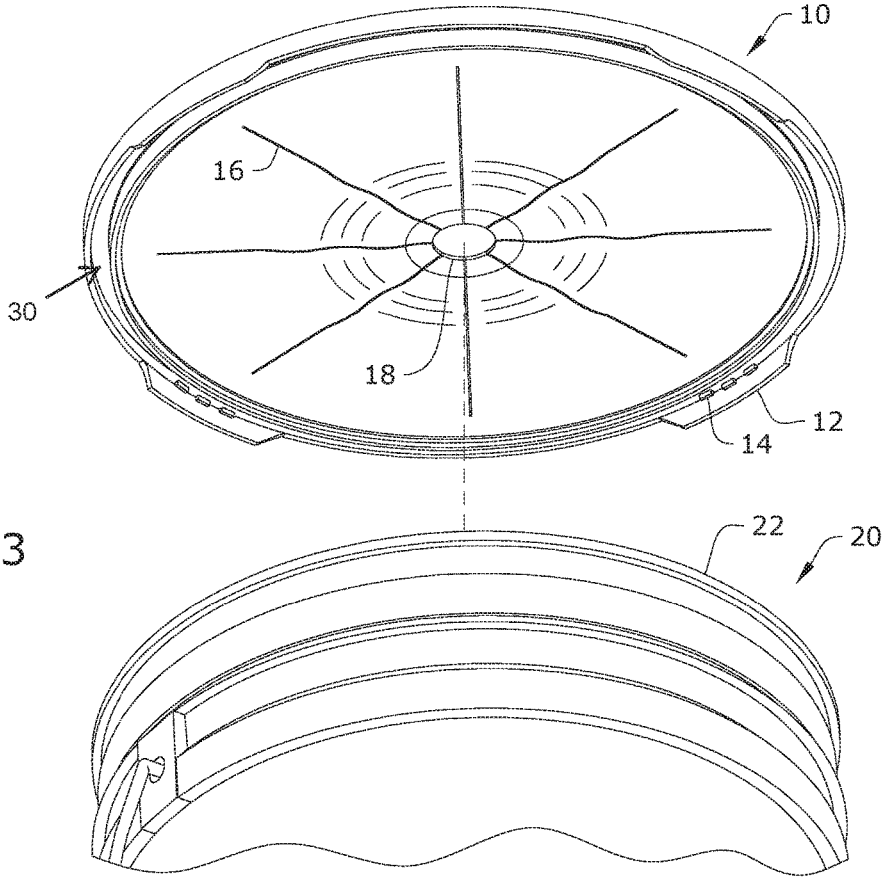
FIG. 3 is a bottom perspective exploded view of an exemplary embodiment of the present invention, shown in use.
Figure 4:
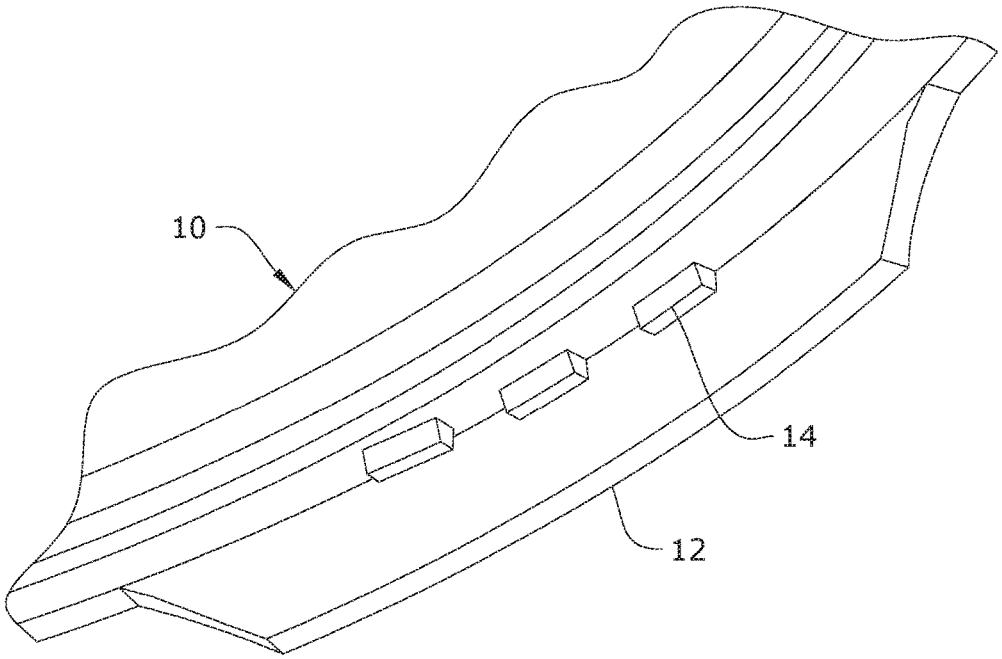
FIG. 4 is a bottom detailed perspective view of an exemplary embodiment of the present invention.

The flexible lid 10 may include a lid rim 28 that is positioned along an outer perimeter portion thereof. The lid rim 28 may provide a handle flange 12 extend outwardly from the lid rim 28 (away from the perimeter portion thereof) along at least one portion thereof, thereby providing spaced apart handle flanges 12 as illustrated in FIG. 3.

Figure 5:
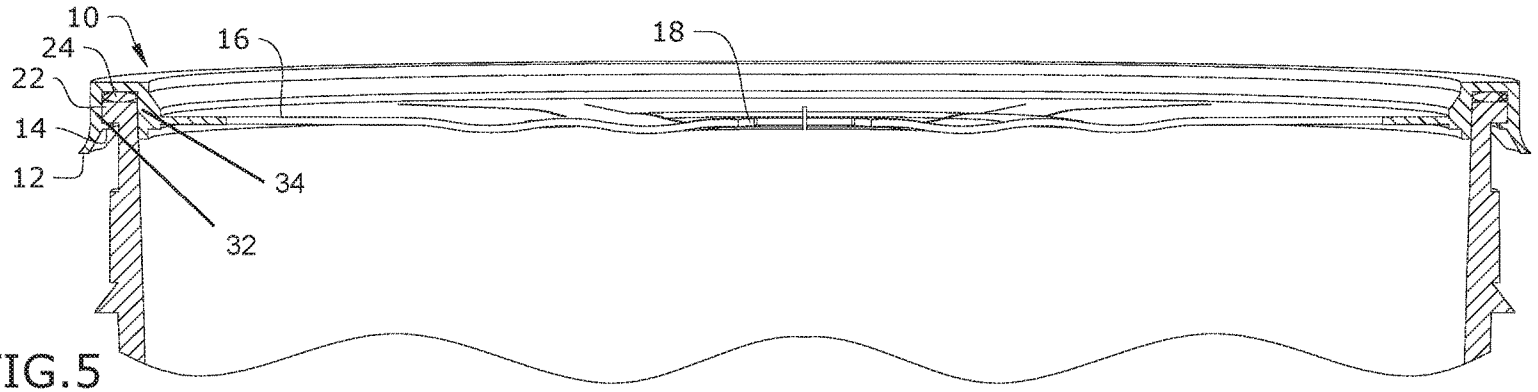
FIG. 5 is a section view of an exemplary embodiment of the present invention, taken along line 5-5 of FIG. 1, demonstrating a flat condition.
Figure 6:
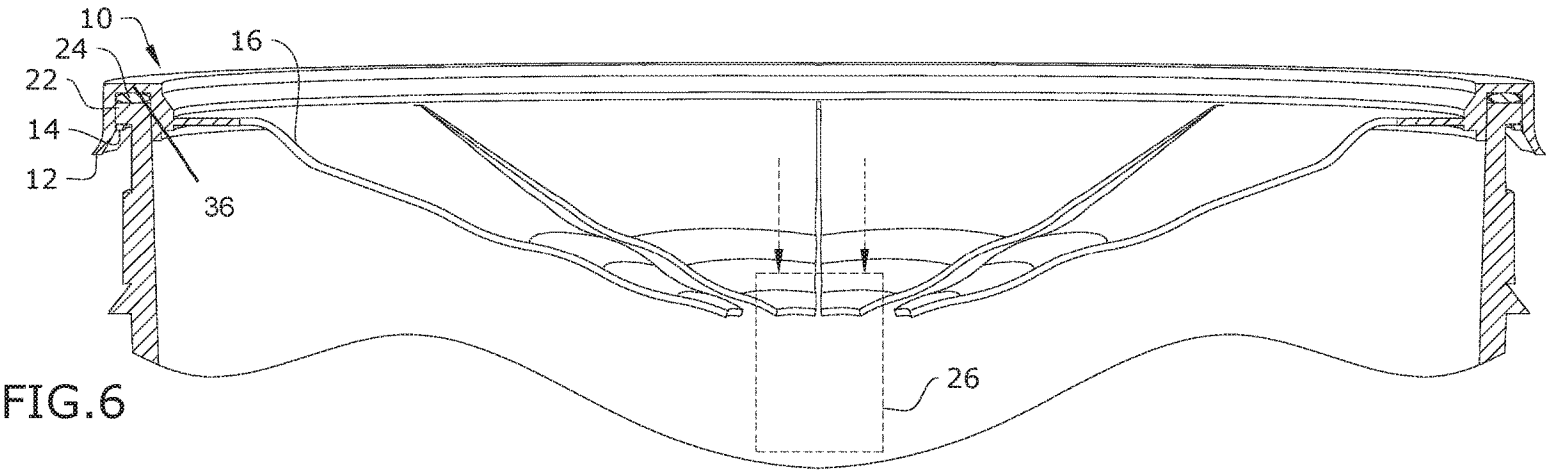
FIG. 6 is a section view of an exemplary embodiment of the present invention, shown in use, demonstrating a bowed condition.

The lid rim 28 may define a downward-facing retaining space 30. The retaining space 30 may be defined by the vertically-oriented, spaced apart exterior portions 32 and 34, a shared top portion 36, as illustrated in FIGS. 5 and 6. The retaining space 30 may be dimensioned and adapted to securely receive a flange portion 22 of the container 20, wherein the flange portion 26 may be a lip, edge, rim, a bead-shaped flange or the like, as illustrated in FIG. 6. In certain embodiments, the top portion 36 may provide a seal element 24 for providing a sealing engagement between the flange portions 26 and the lid rim 28. The seal element 24 may be an adhesive.

The lid rim 28 may providing retaining teeth 14 extending inwardly from the handle flange 12, wherein the retaining teeth 14 are dimensioned and adapted to extend into the retaining space 30 so as to secure the flange portion 22 within in a locking engagement thereto, as illustrated in FIGS. 5 and 6. The locking engagement may be adapted so that the flange portion 22 may not be urged out of the retaining space 30. Similarly, the locking engagement may prevent the lid 10 from being separated from the container 20 through upward pressure on the former and/or downward pressure on the latter. In certain embodiments, the lid rim 28 may be threaded to advantageously enhance securing the flexible lid 10 to the container 20.

The flexible lid 10 may have a lid aperture 50 providing a medial passageway 18, or hole, generally centrally disposed and formed through a central portion of the flexible lid 10. The medial passageway 18 may be dimensioned to receive smaller objects to be placed into the container 20. Smaller objects may, for example, be defined as items that have an outer perimeter or circumference that is smaller than the perimeter or circumference of the medial passageway 18. Extending radially outwardly from the medial passageway 18 is a plurality of elongated narrow openings 16 or slots. The medial passageway 18 may combine with the plurality of narrow openings 16 to form the lid aperture 50 in the flexible lid 10.

The lid aperture 50 may be adapted to receive small objects, as described above, through the medial passageway 18 without relative translation or movement of the plurality of narrow openings 16. The medial passageway 18 may be adapted to work in conjunction with the plurality of narrow openings 16 to receive larger objects 26. In this example, a smaller item is meant to include any item that can fit through the medial passageway 18, and a larger object 26 is meant to include any item that is slightly larger than the circumference of the medial passageway 18, but smaller than the overall perimeter of the flexible lid 10. Moreover, when an object 26 is larger than the medial hole 18 is to be placed into the container 20, the plurality of narrow openings 16 combined with the medial hole 16 extend the void of the entire lid aperture 50. This creates a larger passageway through which the larger objects 26 may be passed through the flexible lid 10 and into the container 20, as illustrated in FIG. 6.

The function of the flexible lid 10 according to the present invention is now described in greater detail. The flexible lid 10 may be positioned to cover the container 20, while simultaneously providing ease of access to the inside of the container 20. The flexible lid 10 may be adapted to only be removed from the container 20 when it is desirable to empty the container contents; otherwise, the flexible lid 10 is adapted to remain secured to the container 20. A user may place a small item through the medial passageway 18 without exerting force upon the flexible lid 10 and without removing the flexible lid 10. A user wishing to place an item into the container that is larger than the diameter/opening of the medial passageway 18, may do so by exerting a small amount of force against the surface of the flexible lid 10, causing the plurality of narrow openings 16 in combination with the medial passageway 18 to extend the diameter/opening of the lid aperture 50 as the flexible lid 10 moves to the bowed condition, creating a large enough passageway through which to accommodate the larger object 26. In other words, the narrow openings 16 in conjunction with the medial passageway 18 expand the size of the entire lid aperture 50 in a bowed, loaded condition as the portions of the lid that define each narrow opening 16 simultaneously move way from each other, as illustrated in FIG. 6. When the exerted force on the lid 10 is removed, the narrow openings 16 return to their original positions in flat unloaded condition to more completely cover the container opening except for the medial passageway 18.

In one embodiment, the present invention may be a circular plastic extrusion with threads located about the inner circumference of its rim 28. However, any material may be used that is sturdy enough to keep its original form intact, yet elastic and/or pliable enough to extend the diameter of the lid aperture 50 as disclosed above, by moving from a flat/unloaded condition to a bowed/loaded condition. The flexible lid 10 may be made of material that can be repeatedly bent without fracturing, such as polyethylene, polypropylene, vinyl, nylon, rubber, various plasticized materials and the like.

Likewise, other shapes of the flexible lid 10 are contemplated to accommodate the different shapes of container openings. For example, and as noted above, the flexible lid 10 may be of a square, rectangular, or polygonal shape depending on the shape of the relative container opening. Furthermore, the rim 28 of the flexible lid 10 may not use threads to secure itself to a container but may simply be sized to tightly surround and secure itself to the perimeter of the container 20. Moreover, any traditional means of securing a lid to a container are contemplated to be within the scope of this invention.

It should be understood, of course, that the foregoing relates to exemplary embodiments of the invention and that modifications may be made without departing from the spirit and scope of the invention as set forth in the following claims.

What is claimed is:

1. A device, comprising:

a sheet of material circumscribed by a rim;

a passageway centrally disposed in the sheet;

a plurality of elongated openings formed in the sheet, each elongated opening radially extending from the passageway toward the rim, the plurality of elongated openings movable between a flat condition and a bowed condition;

a container having a flange portion along a perimeter of its opening, and wherein the rim is adapted to securely engage the flange portion, wherein the rim provides a retaining space adapted for engaging the flange portion, wherein the rim provides a plurality of spaced apart handle flanges extending outwardly from the rim;

a plurality of retaining teeth disposed along each handle flange so that the plurality of retaining teeth extends inward, lockingly engaging the flange portion in the retaining space; and the material biasing the plurality of elongated openings in the flat condition.

2. The device of claim 1, wherein each elongated opening is defined by two adjacent lid segments, and wherein moving to the bowed condition separates the respective two adjacent lid segments.

3. The device of claim 1, wherein moving to the bowed condition expands a void defined by the passageway.

4. A device, comprising:

a sheet of material circumscribed by a rim;

a void centrally disposed in the sheet;

a plurality of elongated openings formed in the sheet, each elongated opening radially extending from the passageway toward the rim, the plurality of elongated openings movable between a flat condition and a bowed condition, and wherein each elongated opening is defined by two adjacent lid segments, and wherein moving to the bowed condition separates the respective two adjacent lid segments and expands the void;

the material biasing the plurality of elongated openings in the flat condition;

the rim providing a retaining space;

a plurality of spaced apart handle flanges extending outwardly from the rim; and a plurality of retaining teeth disposed along each handle flange so that the plurality of retaining teeth extends inward further defining the retaining space.

* * * * *